US006646208B1

(12) United States Patent
Tseng

(10) Patent No.: US 6,646,208 B1
(45) Date of Patent: Nov. 11, 2003

(54) CLAMPING STRIP FOR FASTENING A NEOPRENE WIRE

(76) Inventor: Kuang-Shiun Tseng, P.O. Box No. 6-57, Chung-Ho, Taipei 235 (TW)

( * ) Notice: Subject to any disclaimer, the term of this patent is extended or adjusted under 35 U.S.C. 154(b) by 0 days.

(21) Appl. No.: 10/271,994

(22) Filed: Oct. 17, 2002

(51) Int. Cl.[7] ..... H01B 17/22

(52) U.S. Cl. ..... 174/173; 174/DIG. 12

(58) Field of Search ..... 174/40 R, 40 CC, 174/40 TD, 45 R, 45 TD, 154, 158 R, 158 F, 159, 161 F, 163 R, 166, 172, 173, 175, 178, 182, 191, 192, 193, DIG. 12

(56) References Cited

U.S. PATENT DOCUMENTS 742,890 A * 11/1903 Moore ..... 174/173
2,234,656 A * 3/1941 Schmalz ..... 174/173
2,530,247 A * 11/1950 Koonz ..... 174/158 F
2,744,707 A * 5/1956 Peterson ..... 174/41
2,911,695 A * 11/1959 Knight et al. ..... 174/173
2,959,632 A * 11/1960 Peterson ..... 174/40 R
2,996,691 A * 8/1961 Hafner ..... 174/173
3,069,491 A * 12/1962 Hayden et al. ..... 174/173
3,286,023 A * 11/1966 Eucker ..... 174/173
3,288,918 A * 11/1966 Schlein ..... 174/173
4,015,073 A * 3/1977 Dickerson ..... 174/DIG. 12
4,741,097 A * 5/1988 D'Agati et al. ..... 174/173
4,899,990 A * 2/1990 Winders et al. ..... 174/173

* cited by examiner

*Primary Examiner*—Dean A. Reichard
*Assistant Examiner*—Adolfo Nino
(74) *Attorney, Agent, or Firm*—Troxell Law Office PLLC

(57) ABSTRACT

A clamping strip for fastening a neoprene wire is characterized that the clamping strip has a steel spring strip disposed within an insulating surface layer shielding on the outer surface. The clamping strip has annular body between two ends and a left spiral strip and a right spiral strip formed between the annular body and each of the two ends in wave-shape so as to achieve the main objective of effectively fastening the neoprene wire onto a groove at a neck portion of an insulator.

2 Claims, 12 Drawing Sheets

CLAMPING STRIP FOR FASTENING A NEOPRENE WIRE

BACKGROUND OF THE INVENTION

1) Field of the Invention

The present invention relates to a clamping strip for fastening a neoprene wire, more particularly to a clamping strip capable of intensively fastening the neoprene wire onto a groove of an insulator.

2) Description of the Prior Art

Accordingly, a conventional high pressure neoprene wire (A) has a high conductive metal wire disposed inside and a polyethylene (PE) or polyvinyl chloride (PVC) shielding member covering the outer portion thereof; usually, the high pressure neoprene wire (A) is supported on an insulator of a high pressure electric wire post or tower. As indicated in FIGS. 10 and 11, the supporting structure mainly includes a transverse concave slot (B1) disposed at an upper rim side of an insulator (B) for inserting the neoprene wire (A). A flexible aluminum fastening strip (C) ties the neoprene wire (A) onto the insulator (B). The aluminum fastening strip (C) has an aluminum wire disposed inside and the PE or PVC shield covering outside. The physical nature of the aluminum fastening strip (C) is considerably flexible and extensive. Therefore, in strong wind possibly caused by typhoon or torrential rain, no matter how tight the neoprene wire (A) is fastened onto the insulator (B), the aluminum fastening strip (C) definitely loosens up due to the extensibility thereof; that might further cause the neoprene wire (A) to be blown down or damaged. This kind of accident happens quite often during the typhoon season; it usually cuts off the electricity supply and hinders the repairing operation. Therefore, the shortcoming of the conventional structure has to be improved, otherwise the drop and break of the neoprene wire (A) might cause considerate damage and cost.

Furthermore, the worker has to manually or uses a manual tool to fixedly coil the neoprene wire (A) onto the insulator (B) via the aluminum fastening strip (C); the hands move at wide angles to finish detailed operation; the worker has to stand on the high tower and that makes the hand movement not smooth and hard to control.

SUMMARY OF THE INVENTION

In viewing the abovementioned shortcomings, the inventor of the present invention researched for an operating tool to efficiently fasten a neoprene wire onto an equilateral groove of an insulator.

Therefore, the primary objective of the present invention is to provide a clamping strip for fastening a neoprene wire so as to efficiently and intensively fasten the neoprene wire onto a lateral side or a groove on a top portion of the insulator.

Another objective of the present invention is to provide a clamping strip for fastening a neoprene wire; the clamping strip can works as a connector of a fence.

To achieve the abovementioned objectives of the present invention, the brief description of the drawings below is followed by the detailed description of the preferred embodiment.

DETAILED DESCRIPTION OF THE PREFERRED EMBODIMENTS

Figure 1A:
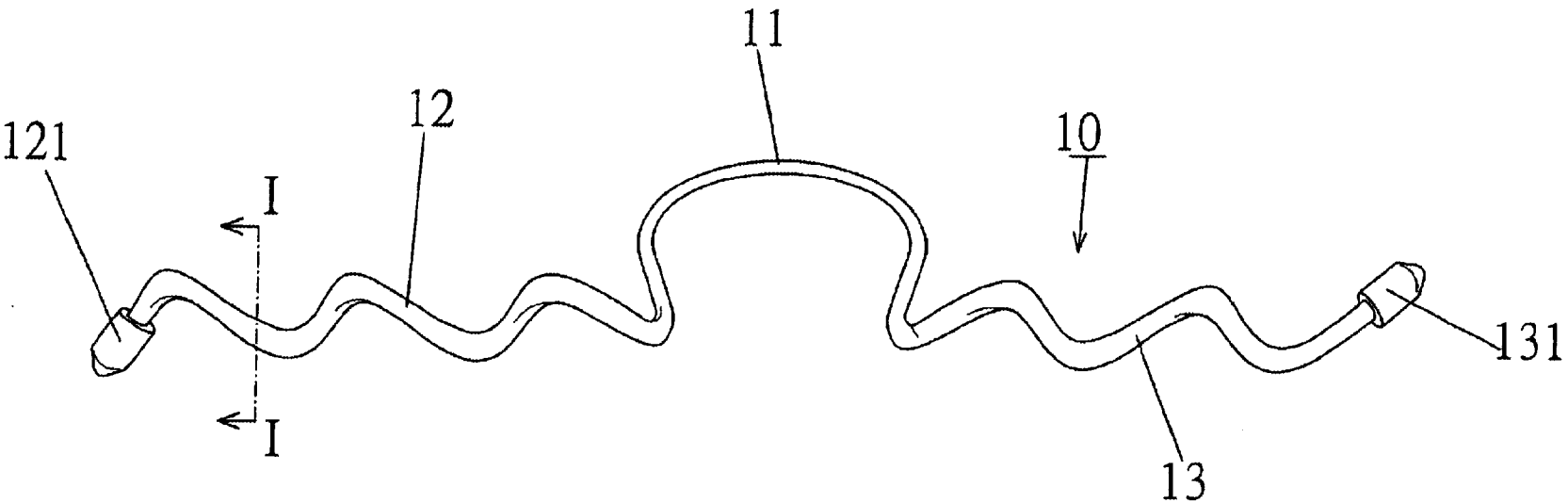
FIG. 1A is a pictorial drawing of the present invention.
Figure 1B:
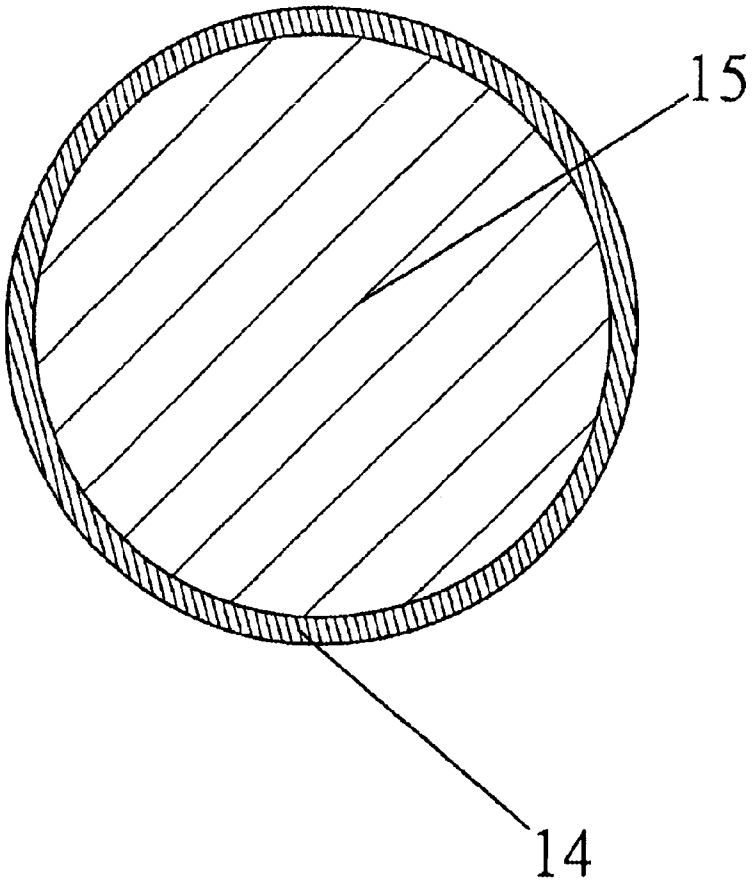
FIG. 1B is a cross-sectional drawing of the line I—I in FIG. 1.

Referring to FIGS. 1A and 1B, the structure of the present invention comprises a clamping strip (10) with a steel spring strip (15) disposed therein and an insulating surface layer (14) shielding on the outer surface thereof; wherein an annular body (11) for retaining is disposed inside the clamping strip (10); two ends of the annular body (11) extends transversely toward the opposite directions to form a left spiral strip (12) and a right spiral strip (13) in wave-shape.

According to the abovementioned main features, the distal ends of the left and right spiral strips (12, 13) respectively connect moving bodies (121, 131) with larger diameters.

Figure 3:
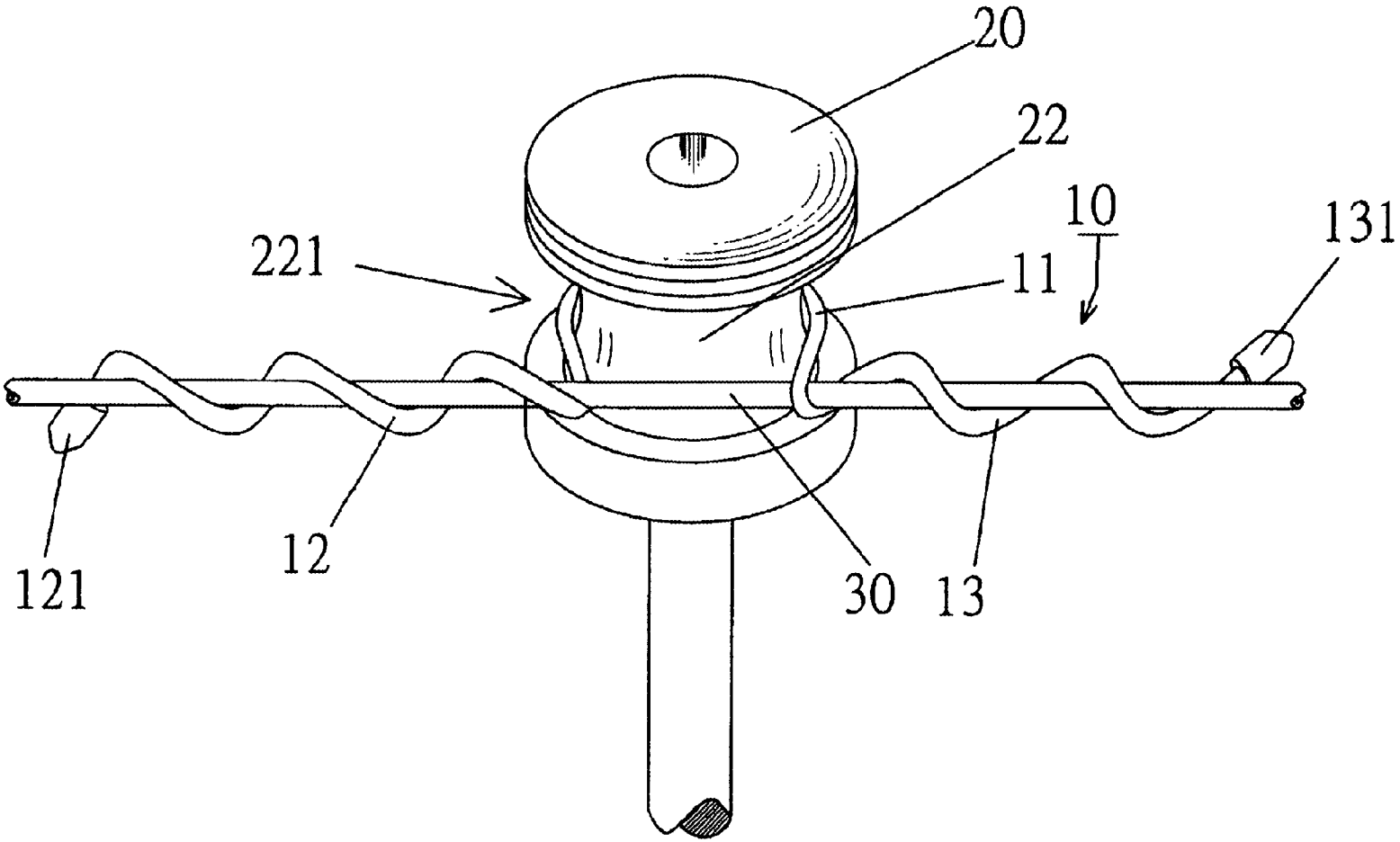
FIG. 3 is a pictorial drawing of using the present invention to fasten a neoprene wire onto a groove of the insulator.
Figure 4:
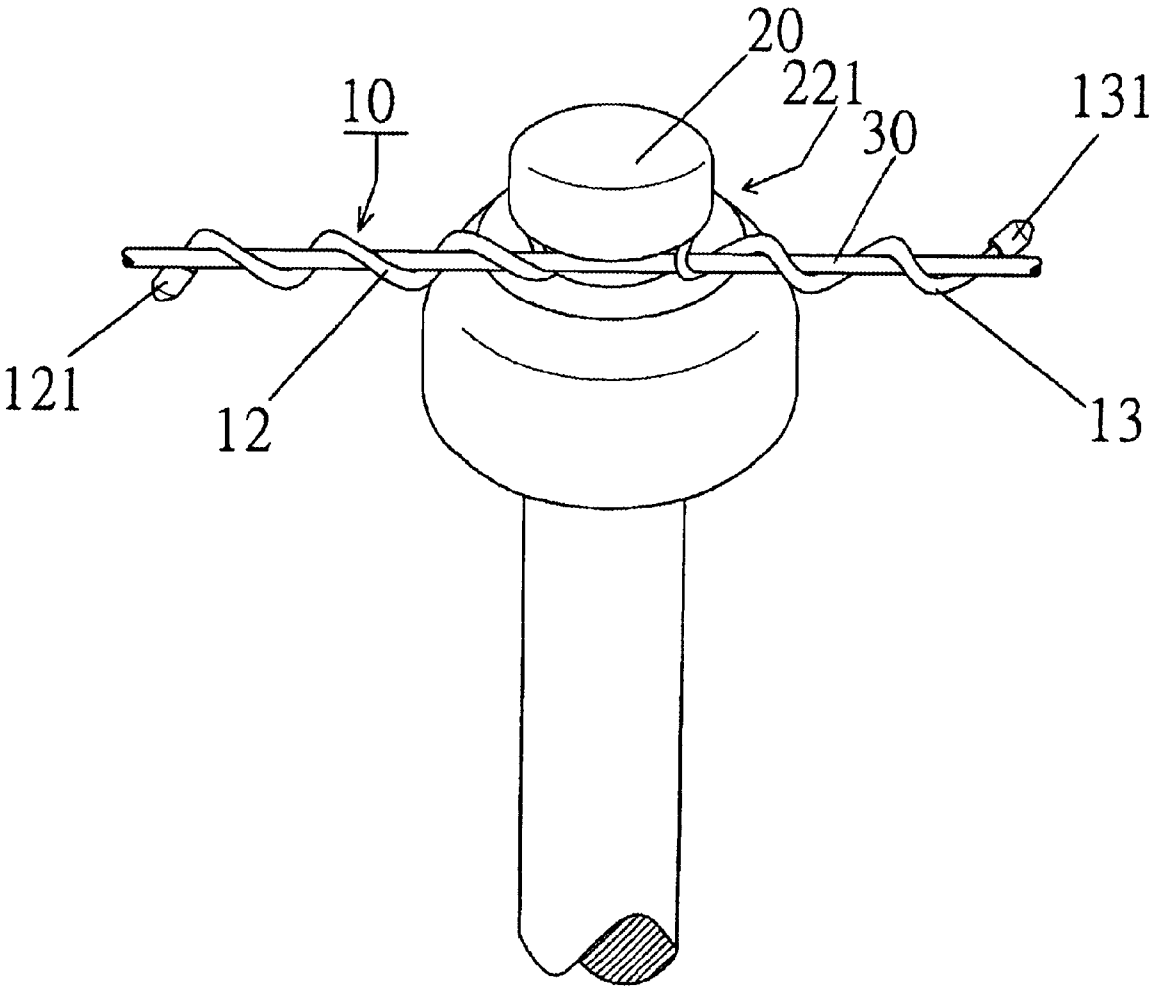
FIG. 4 is a pictorial drawing of using the present invention to fasten a neoprene wire onto a groove of an insulator in another shape.

According to the abovementioned main features, the annular body (11) winds around a neck portion (22) of an insulator (20); the left and right spiral strips (12, 13) intensively fasten a neoprene wire (30); furthermore, the neoprene wire (30) is fastened onto a groove (221) formed at the neck portion (22) of the insulator (20), as indicated in FIGS. 3 and 4.

Figure 5:
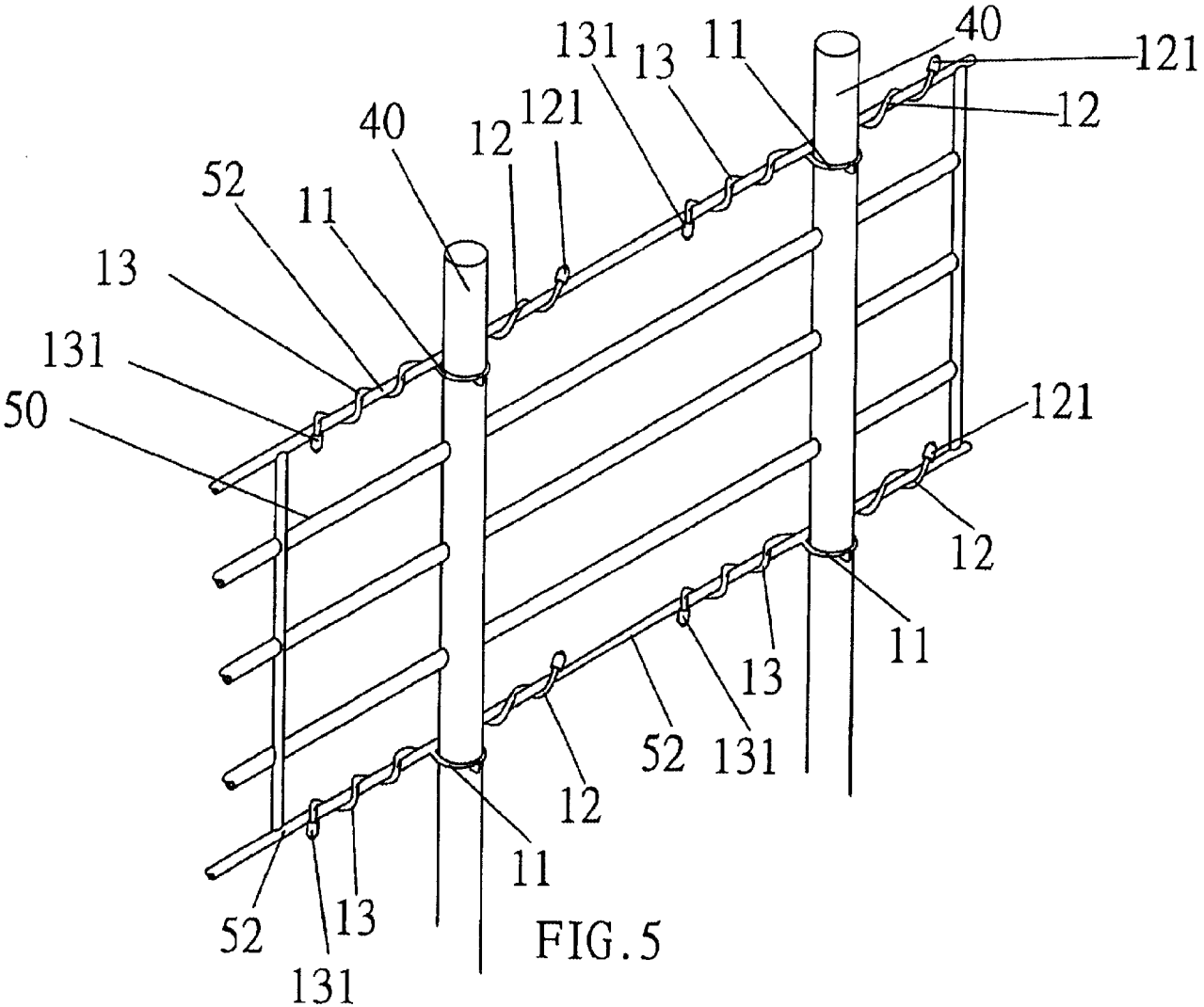
FIG. 5 is a pictorial drawing of the assembly using the present invention as a connector for a hedge and a rod.

According to the abovementioned main features, wherein the annular body (11) selectively winds around a rod-shape object (40); the left and right spiral strips (12, 13) intensively fasten around transverse rods (52) on the upper and lower rim sides of a hedge (50) to further work as a connector between the hedge (50) and the rod-shape object (40), as indicated in FIG. 5.

Figure 6:
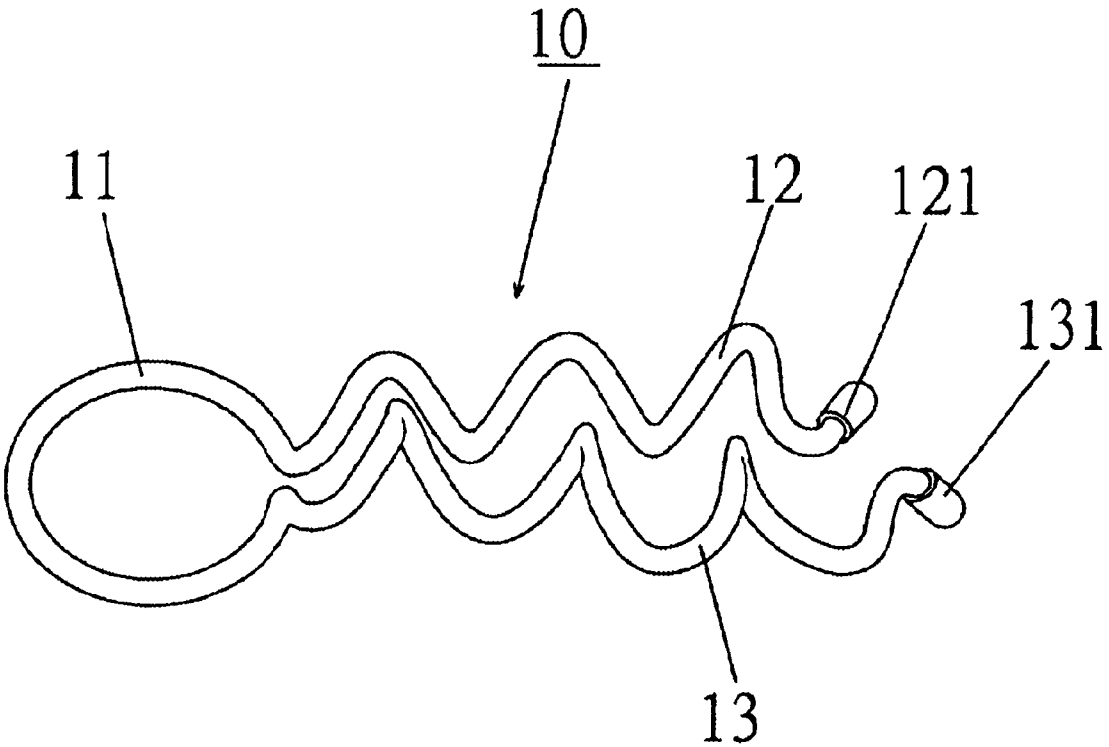
FIG. 6 is a pictorial drawing of another exemplary embodiment of the present invention.
Figure 7:
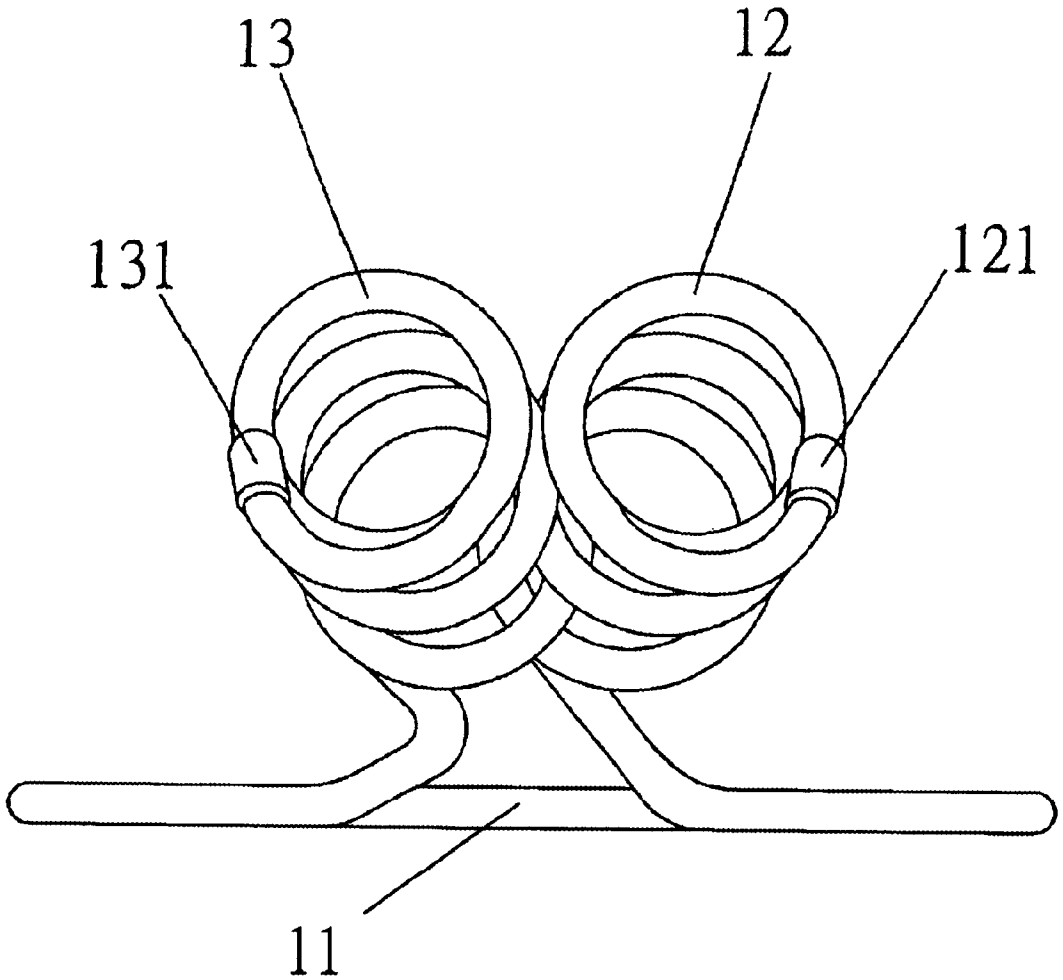
FIG. 7 is a rear view drawing of FIG. 6.

According to the abovementioned main features, the left and right spiral strips (12, 13) are distributed selectively to extend along the same outer lateral side of annular body (11), as indicated in FIGS. 6 and 7.

Figure 2:
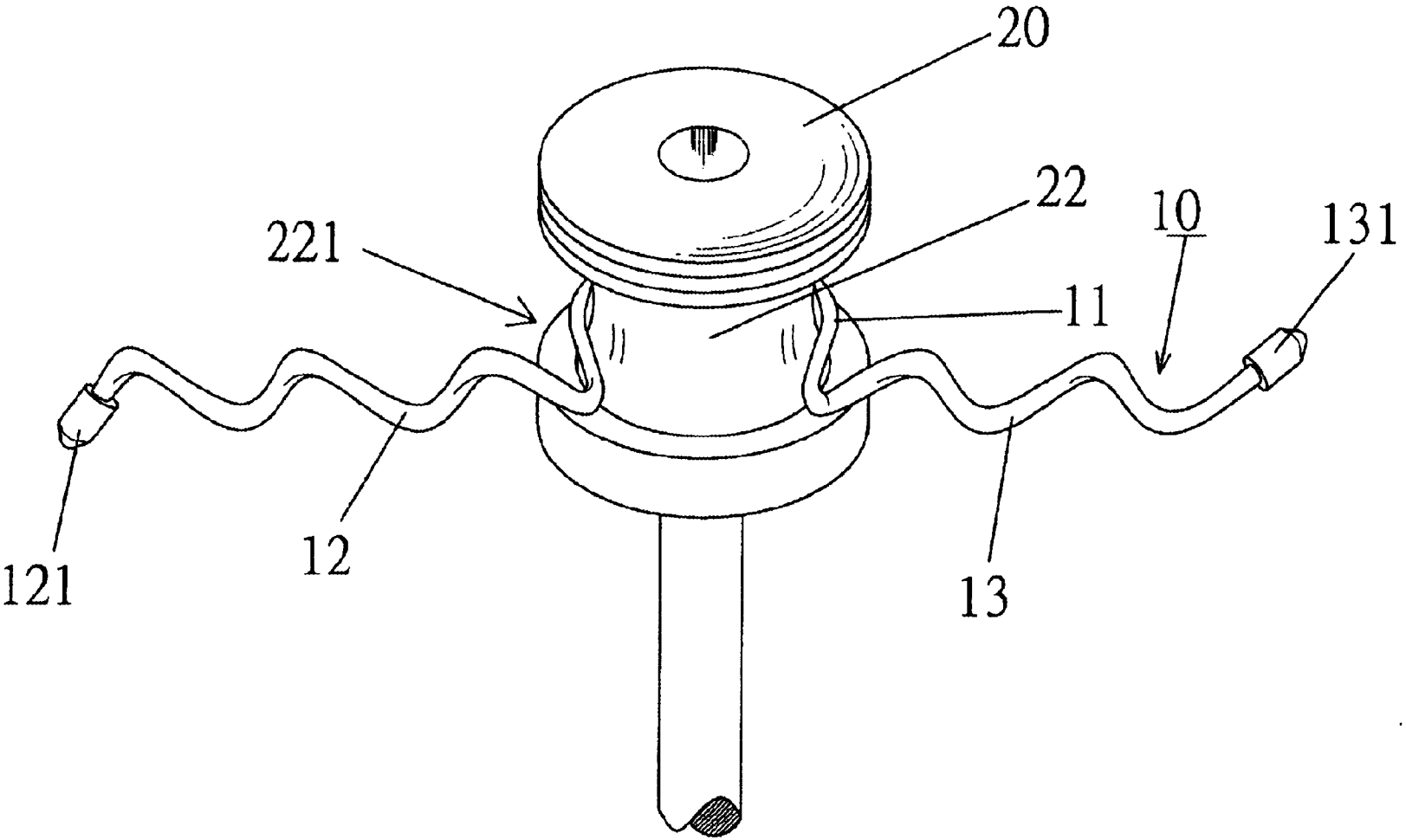
FIG. 2 is a pictorial drawing of winding the present invention onto an insulator.

The exemplary implementation of the present invention has the following excellent effects:

1. The insulator (20) has the neck portion (22) disposed with the groove (221) on the outer lateral space thereof; the design of the groove (221) allows the neoprene wire (30) to be fastened. As indicated in FIG. 2, the present invention uses a single clamping strip (10) to retain the annular body (11) into the neck portion (22) for initially positioning the clamp strip (10). At this time, the left and right spiral strips (12, 13) are positioned on the left and right sides of the insulator (20) and distributed transversely. Then, as indicated in FIG. 3, the left and right spiral strips (12, 13) are manually and sequentially coiled around the surface of the neoprene wire (30) in a regular movement. At this moment, the neoprene wire (30) is intensively fastened by the left and right spiral strips (12, 13) to be efficiently positioned on the lateral groove (221). The left and right spiral strips (12, 13) have an extreme gripping force since they are composed by the steel spring strip (15). They won't loose up even under the attack of strong wind. Moving bodies (121, 131) with a larger diameter is respectively inserted at tail ends of the left and right spiral strips (12, 13) to convenience the finger operation and the left and right spiral strips (12, 13) in assembling or detaching the neoprene wire (30).

2. As indicated in FIG. 5, with the intensive gripping force, the clamping strip (10) is capable of fastening the hedge (50). It merely needs to retain the annular body (11) onto the rod-object (40) as well as to circle the left and right spiral strips (12, 13) onto the transverse rods (52) so as to intensively fasten the hedge onto the transverse rods (52). Therefore, the clamping strip (10) works as a connector to be fast assembled or detached and to substitute the conventional structure requiring a soldering or screwing connection.

Figure 8:
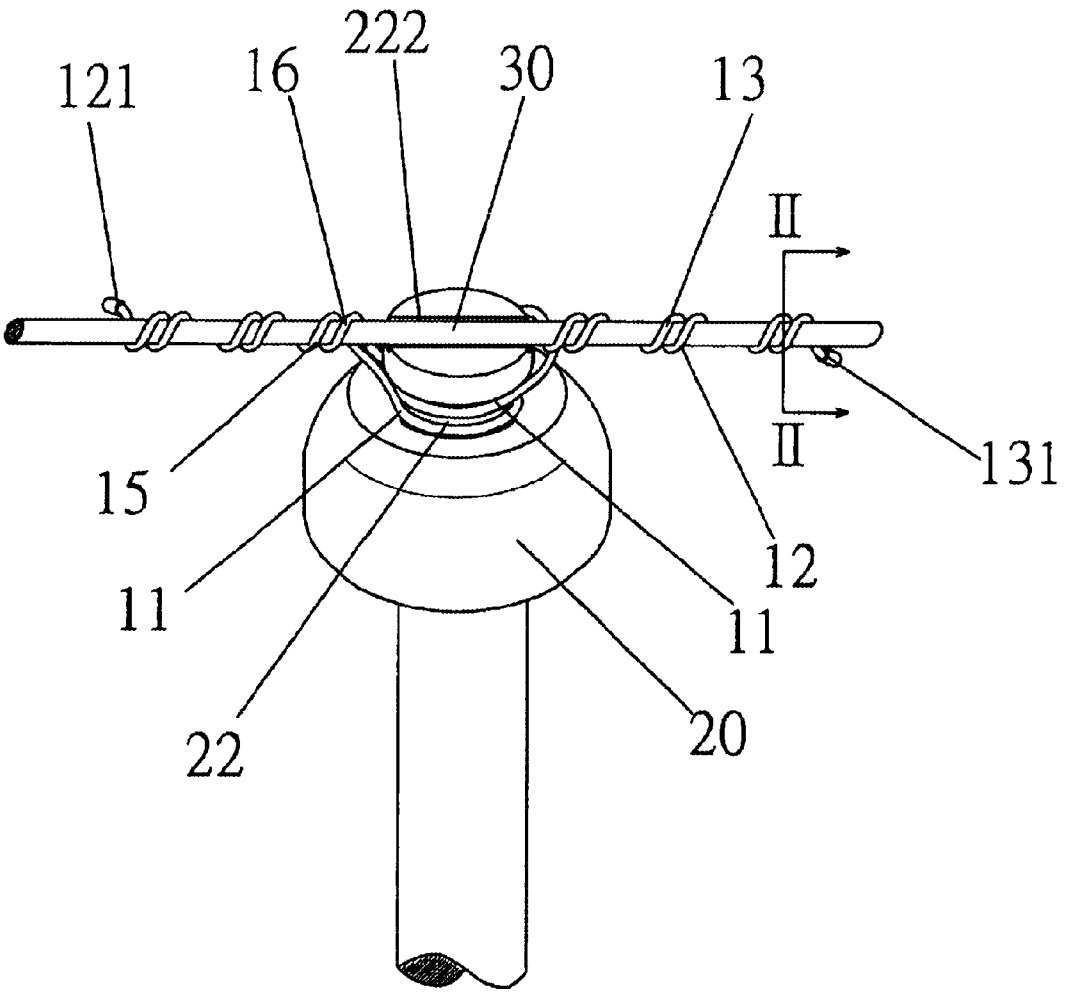
FIG. 8 is a pictorial drawing of using two strips of the present invention to fasten an object onto the insulator.
Figure 9:
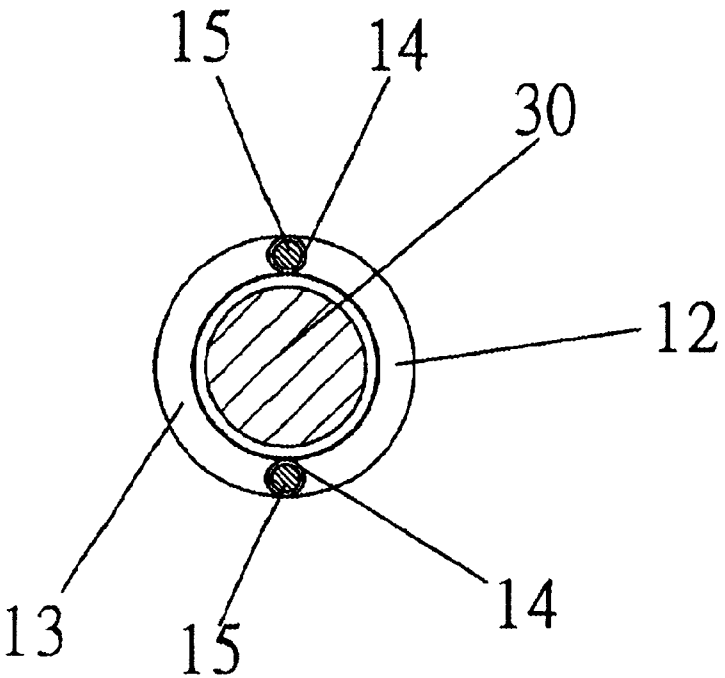
FIG. 9 is a cross-sectional drawing of the line II—II in FIG. 8.
Figure 10:
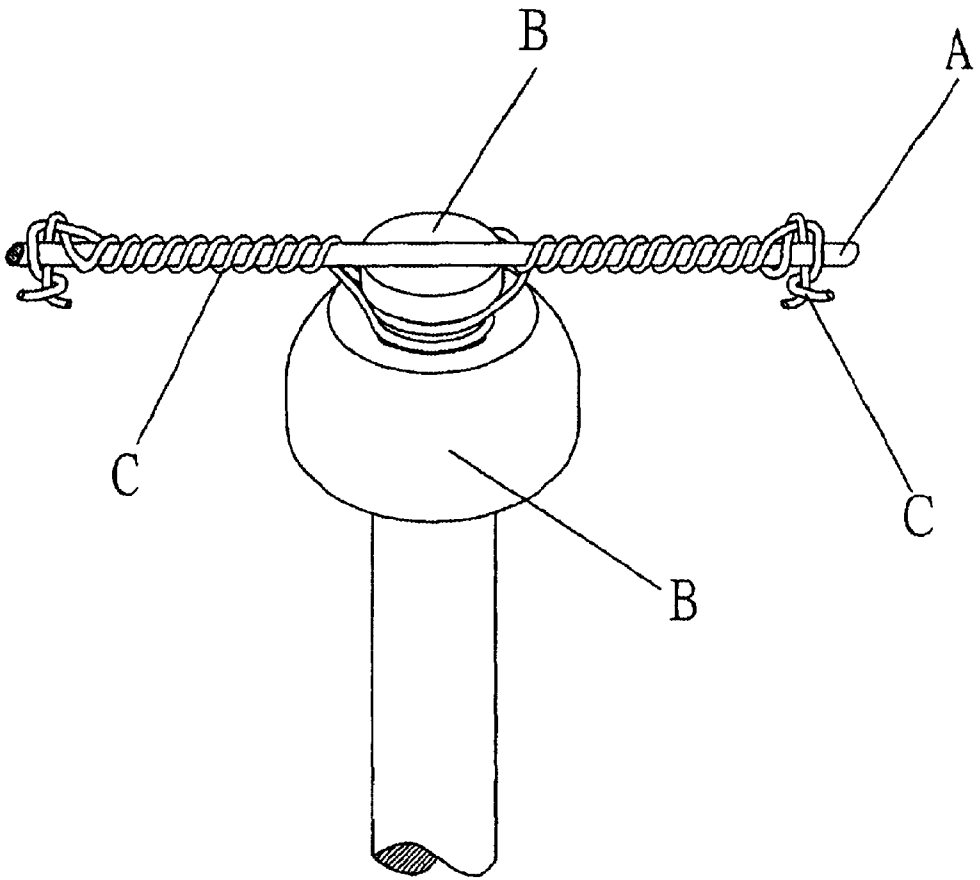
FIG. 10 PRIOR ART
FIG. 10 is a pictorial drawing of fastening an electric wire onto the insulator via a conventional aluminum strip.
Figure 11:
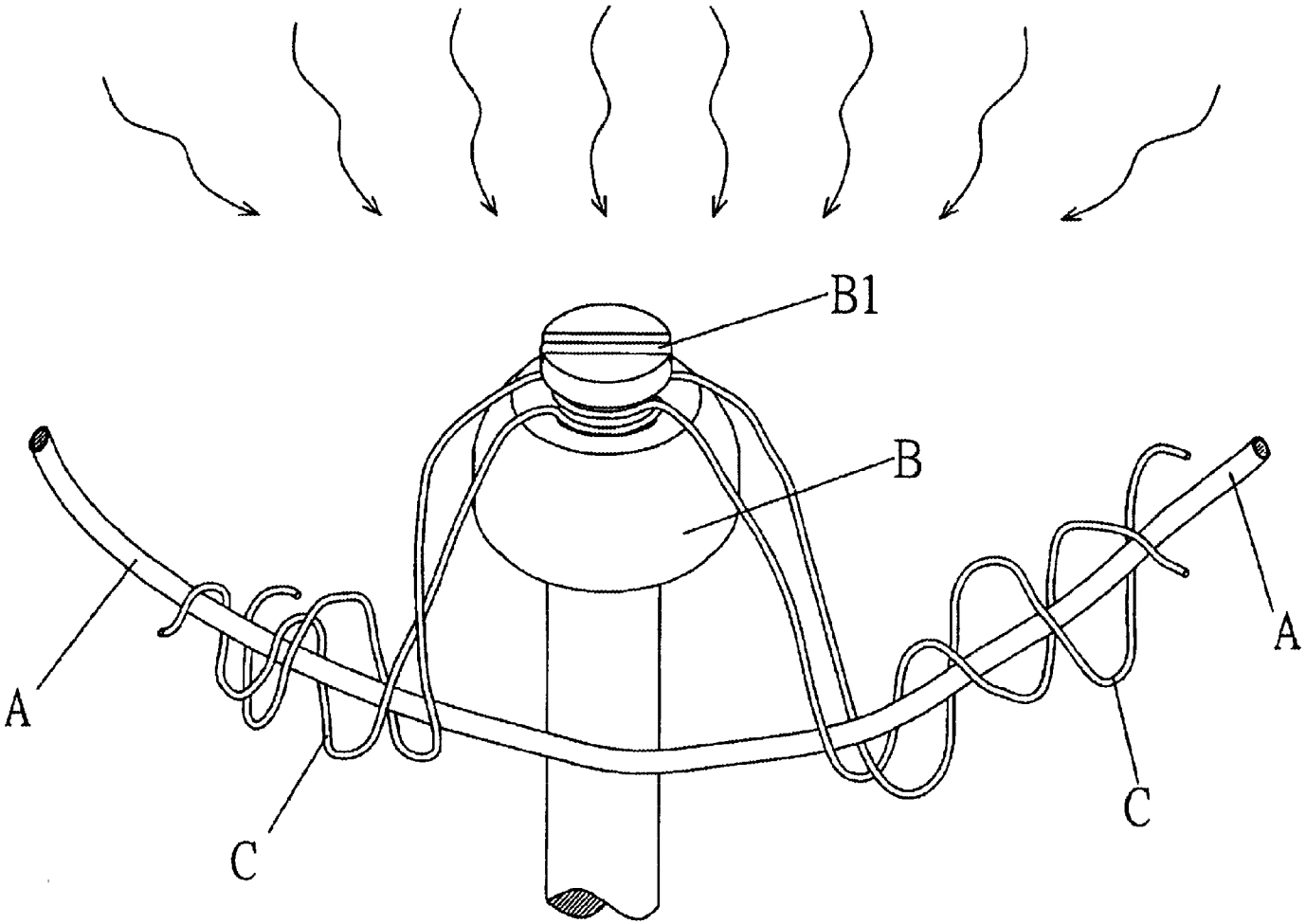
FIG. 11 PRIOR ART
FIG. 11 is a pictorial drawing of a conventional aluminum strip dropping the electric wire from the insulator.

3. As indicated in FIG. 6 of another exemplary embodiment of the present invention, wherein the left and right spiral strips (12, 13) are disposed on the same side of the annular body (11); FIG. 7 is the rear view drawing of FIG. 6. The left and right spiral strips (12, 13) are disposed slightly high than the annular body (11); furthermore, parts of the left and right spiral strips (12, 13) cross each other. As indicated in FIG. 8, two clamping strips (10) retain on the neck portion (22) of the insulator (20); the insulator (20) has a top portion groove (222) allowing the left and right spiral strips (12, 13) of each clamping strip (10) to be respectively fastened onto the top portion groove (222) of the insulator (20); a plurality of left and right spiral strips (12, 13) wind and retain on the left and right sides of the neoprene wire (30) thereby firmly and intensively fastening the neoprene wire (30) onto the insulator (20). This exemplary implementation shows that when it is necessary, the design of the top portion groove (222) on the insulator (20) more intensively and efficiently fastens the neoprene wire (30).

In summation of the abovementioned, the improved design of the clamping strip (10) efficiently fastens the neoprene wire (30) onto the grooves (221, 222) of the insulator (20); furthermore, the clamping strip (10) is capable of working as a connector between the object of construction material in a rodshape and the hedge.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A clamping strip for fastening a wire comprising:

a) a steel spring strip having: an annular body with opposite first and second ends; a first spiral strip extending outwardly from the annular body to the first end; a second spiral strip extending outwardly from the annular body to the second end, the first spiral strip and the second spiral strip each having a helical shape, an enlarged first moving body at a distal end of the first spiral strip; and an enlarged second moving body at a distal end of the second spiral strip; and b) an insulating surface layer covering the at least one steel spring strip.

2. The clamping strip for fastening a wire according to claim 1, wherein the steel spring strip has a circular cross-section.

* * * * *